US008950791B2

(12) United States Patent
Yamagata

(10) Patent No.: US 8,950,791 B2
(45) Date of Patent: Feb. 10, 2015

(54) DOOR LOCK DEVICE

(75) Inventor: Mikio Yamagata, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 696 days.

(21) Appl. No.: 12/388,763

(22) Filed: Feb. 19, 2009

(65) Prior Publication Data

US 2009/0218830 A1 Sep. 3, 2009

(30) Foreign Application Priority Data

Feb. 28, 2008 (JP) ..... 2008-048208

(51) Int. Cl.

| | |
|---|---|
| ***E05C 3/06*** | (2006.01) |
| ***E05B 81/24*** | (2014.01) |
| *E05B 63/00* | (2006.01) |
| *E05B 77/30* | (2014.01) |

(52) U.S. Cl.

CPC ..... *E05B 81/25* (2013.01); *E05B 63/0056* (2013.01); *E05B 77/30* (2013.01)

USPC ..... 292/201

(58) Field of Classification Search

CPC ..... E05B 81/14; E05B 85/226

USPC ..... 292/201, 210, 216, DIG. 23

See application file for complete search history.

(56) References Cited

U.S. PATENT DOCUMENTS

| | | | | |
|---|---|---|---|---|
| 3,608,941 | A * | 9/1971 | Kondo et al. | 292/280 |
| 3,941,411 | A * | 3/1976 | Pringle | 292/26 |
| 4,382,622 | A * | 5/1983 | Ishikawa | 292/216 |
| 4,575,138 | A * | 3/1986 | Nakamura et al. | 292/216 |
| 5,971,449 | A * | 10/1999 | Rogers, Jr. et al. | 292/216 |
| 6,575,506 | B2 * | 6/2003 | Hayakawa et al. | 292/216 |
| 6,634,682 | B2 * | 10/2003 | Fukunaga et al. | 292/216 |
| 6,733,052 | B2 * | 5/2004 | Perkins et al. | 292/201 |
| 2004/0262927 | A1 * | 12/2004 | Fukunaga et al. | 292/216 |
| 2005/0167991 | A1 * | 8/2005 | Yoneyama | 292/201 |
| 2008/0023971 | A1 * | 1/2008 | Akizuki et al. | 292/201 |

FOREIGN PATENT DOCUMENTS

WO WO 2006099730 * 9/2006

* cited by examiner

*Primary Examiner* — Kristina Fulton
*Assistant Examiner* — Nathan Cumar
(74) *Attorney, Agent, or Firm* — Wenderoth, Lind & Ponack, LLP

(57) ABSTRACT

A door lock device which can widely use common parts between one with an override function and one without an override function and can be constructed by a reduced number of parts. The door lock device includes a latch mechanism having an operation receiving portion for releasing an engaged state of a striker, a link being movable between an unlock position and a lock position, a lock plate positioning the link at the unlock position and the lock position, a knob lever actuating the lock plate to move the link to the lock position or the unlock position, and an inner lever releasing the engaged state of the striker by the latch mechanism via the link. The knob lever is provided with an engagement receiving portion. The inner lever is provided with an engaging portion engaging with the engagement receiving portion to move the link to the unlock position via the knob lever and the lock plate.

7 Claims, 6 Drawing Sheets

(A)

(B)

DOOR LOCK DEVICE

BACKGROUND OF THE INVENTION

1. Technical Field

The present invention relates to a door lock device installed to a door of a vehicle.

In the vehicle, an approximately U-shaped striker is arranged in a vehicle body, and a door lock device detachably engaging the striker is arranged in a door. The door lock device is provided with a latch mechanism for engaging the striker, and a lock mechanism for releasing an engagement of the striker by the latch mechanism. The lock mechanism is switched between an unlocked state capable of actuating the latch mechanism and a locked state incapable of actuating the latch mechanism, through an operation of an inner lock knob arranged in a vehicle inner side of the door, and an operation of a cylinder lock arranged in a vehicle outer side of the door. Further, in the locked state, the latch mechanism can not be actuated even by operating an inner handle arranged in the vehicle inner side of the door or an outer handle arranged in the vehicle outer side of the door. Further, in the unlocked state, the latch mechanism can be actuated so as to release the engagement of the striker, through an operation of the inner handle or the outer handle.

2. Description of the Related Art

In this type of door lock device, there is a structure (an override function) provided only in, for example, a door of a driver seat in which the lock mechanism is unlocked by operating the inner handle and the engagement of the striker can be released in succession by the latch mechanism in a case that the lock mechanism is in the locked state.

As a related art document information of the door lock device having such an override function, there exists Japanese Unexamined Patent Publication No. 2001-248348.

In a door lock device of Japanese Unexamined Patent Publication No. 2001-248348, an inside lever and a second sublever are arranged as an inner handle operating system, and an outside lever, a coupling lever and a sublever are arranged as an operating system of an outer handle.

When a lock and unlock lever is positioned at an unlock position, the outside lever is moved from an inoperative position to an operative position, whereby the sublever comes into contact with an open lever to allow the open lever to rotate in an open direction. Accordingly, the door can be opened. On the other hand, when the lock and unlock lever is positioned at a lock position, the sublever does not reach the open lever even if the outside lever is moved from the inoperative position to the operative position, preventing the open lever from opening in the open direction. Therefore, the door cannot be opened.

Further, as the second sublever is coupled to the inside lever, if the inside lever is rotated from the inoperative position to the operative position, the second sublever is pulled upward, allowing the open lever to move up and rotate in an open direction so that the door can be opened. In other words, in a case of operating the inside lever, it is possible to always open the door directly regardless of whether the lock and unlock lever is at the lock position or the unlock position.

However, since the door lock device described in Japanese Unexamined Patent Publication No. 2001-248348 is designed exclusively for providing the override function, it is necessary to mount a different independently designed door lock device in a case that the override function is not provided. In other words, since it is necessary to mount completely different door lock devices such as in a case where the override function is not provided depending on a door even in the same vehicle, a case where the override function is not provided depending on a grade even in the same types of vehicle, or the like, a cost increase is caused. Further, since the door lock device described in Japanese Unexamined Patent Publication No. 2001-248348 is provided with respective parts of the operating system of the inner handle and the operating system of the outer handle, the number of the parts is increased, and a cost of the door lock device itself becomes high.

SUMMARY OF THE INVENTION

The present invention is made in view of the aforementioned problems, and an object of the present invention is to provide a door lock device which can widely use common parts between one with an override function and one without an override function and can be constructed by a reduced number of parts.

In order to achieve the object mentioned above, in accordance with the present invention, there is provided a door lock device including:

a latch mechanism detachably engaging a striker and having an operation receiving portion for releasing an engaged state;

a link being movable between an unlock position capable of engaging with the operation receiving portion of the latch mechanism and capable of releasing the engaged state of the striker, and a lock position incapable of engaging with the operation receiving portion and incapable of releasing the engaged state of the striker;

a lock plate positioning the link at the unlock position and the lock position;

a knob lever coupled to a lock knob provided in a vehicle inner side of a door and engaged with the lock plate, the knob lever actuating the lock plate to move the link to the lock position or the unlock position; and an inner lever coupled to an inner handle provided in the vehicle inner side of the door and engaged with the link, inner lever releasing the engaged state of the striker by the latch mechanism via the link in a state that the link is moved at the unlock position, wherein the knob lever is provided with an engagement receiving portion, and the inner lever is provided with an engaging portion, and wherein the engaging portion is capable of engaging with the engagement receiving portion of the knob lever to move the link to the unlock position via the knob lever and the lock plate, in a state that the link is moved to the lock position, and is incapable of engaging with the engagement receiving portion of the knob lever, in a state that the link is moved to the unlock position.

In accordance with the door lock device, when the inner handle is operated in the unlocked state, the engaging portion of the interlocking inner lever comes into contact with the link without being engaged with the engagement receiving portion of the knob lever, actuating the operation receiving portion of the latch via the link, and releases the engagement of the striker. On the other hand, if the inner handle is operated in the locked state, the engaging portion of the interlocking inner lever engages with the engagement receiving portion of the knob lever, thereby moving the knob lever and moving the link to the unlock position via the lock plate. As a result, in the same manner as the operation in the unlocked state, it is possible to actuate the latch via the link by the inner lever, and to release the engagement of the striker.

As mentioned above, in accordance with the present invention, as the engagement receiving portion is provided in the knob lever and the engaging portion is provided in the inner lever, it is possible to provide an override function capable of opening the door in the locked state. Accordingly, it is possible to construct the door lock device which is not provided with the override function, by further providing a second inner lever having no engaging portion in addition to the inner lever, or further providing a second knob lever having no engagement receiving portion in addition to the knob lever, and selectively assembling them in the door lock device. In other words, it is possible to construct the door lock device which is provided with the override function, and the door lock device which is not provided with the override function, by changing only one part, and using the other parts in common. As a result, since it is possible to reduce a cost of the door lock device itself mounted to the vehicle, and to reduce a cost of a whole vehicle.

In this door lock device, it is preferable to arrange the inner lever, the link and the knob lever adjacently in a lateral direction, in such a manner that the inner lever is positioned between the link and the knob lever. In accordance with the structure mentioned above, it is possible to relatively easily achieve a structure in which the inner lever can be engaged with the link, in a state that the engagement receiving portion of the knob lever and the engaging portion of the inner lever can securely engage each other.

Further, it is preferable to further provide a push lever which is coupled to the outer handle provided in the vehicle outer side of the door, and is engaged with the link. In accordance with this structure, since the link for actuating the latch is used in common between the inner handle operating system and the outer handle operating system, and is operated directly in each of the inner lever and the push lever, it is possible to reduce a number of parts, and to reduce a manufacturing cost.

Further, it is preferable that the latch mechanism is provided with a fork engaging the striker, and a claw engaged with the fork so as to maintain the fork in a state of holding the striker, and the operation receiving portion is provided in the claw. In accordance with this structure, since the claw can be directly operated by the link, it is possible to further reduce the number of parts and to reduce the manufacturing cost.

In accordance with the present invention, it is possible to achieve a door lock device which is provided with the override function, by arranging the knob lever having the engagement receiving portion and the inner lever having the engaging portion. Further, it is possible to construct the door lock device which is not provided with the override function, by setting at least one of the knob lever and the inner lever to the second knob lever or the inner lever which is not provided with the engagement receiving portion or the engaging portion. Accordingly, the other parts except the knob lever and/or the inner lever are identical between the door lock device which is provided with the override function and the door lock device which is not provided therewith. As a result, since most of the parts can be used in common, it is possible to reduce a cost of the door lock device itself. Accordingly, it is possible to reduce a cost of the vehicle itself mounting the door lock device thereon.

BRIEF DESCRIPTION OF THE DRAWINGS

FIGS. 1A and 1B show views of a door lock device in accordance with the present invention, in which FIG. 1A is a front elevational view showing a lock mechanism, and FIG. 1B is a side elevational view showing a latch mechanism;

DETAILED DESCRIPTION OF THE PREFERRED EMBODIMENTS

A description will be given of an embodiment in accordance with the present invention with reference to the accompanying drawings.

Figure 1:
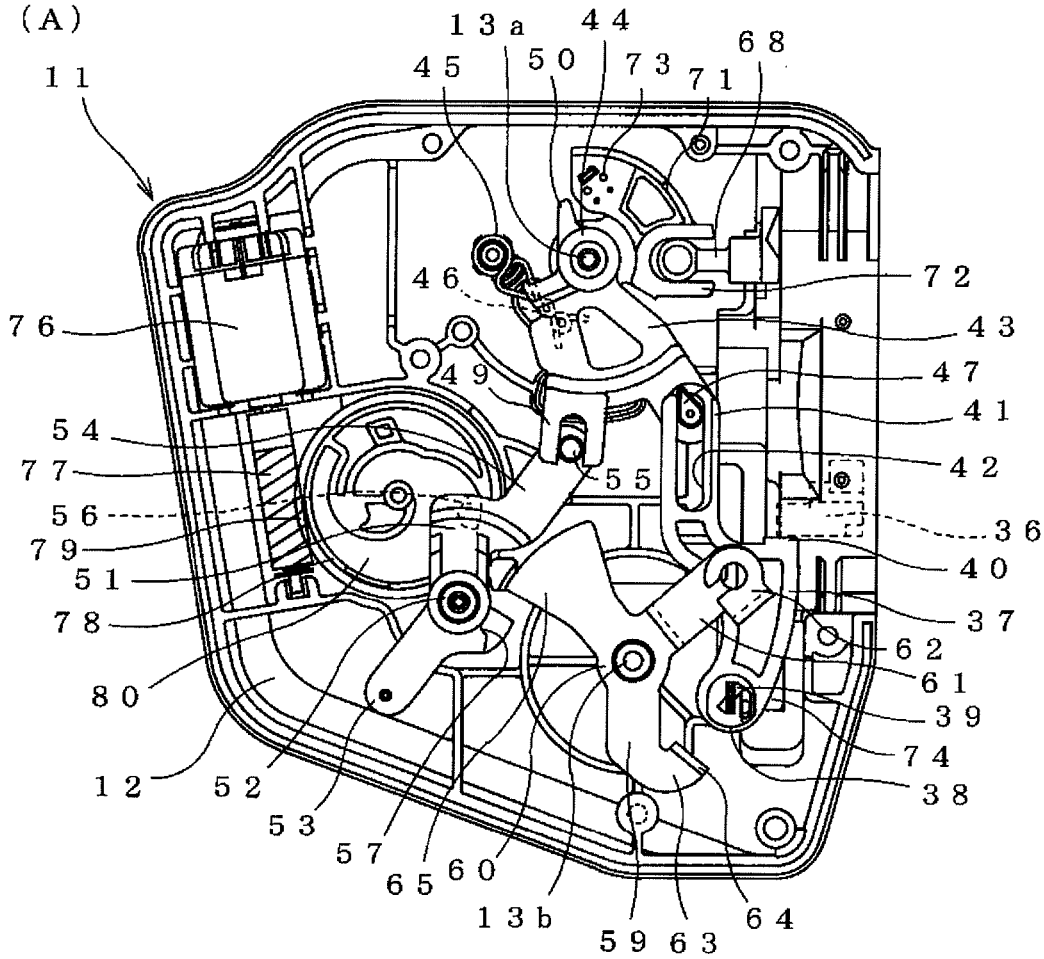
Figure 1:
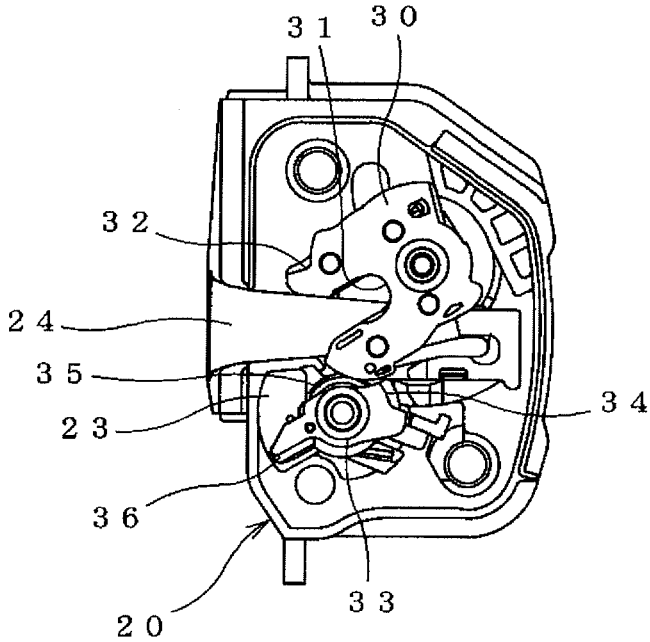
Figure 2:
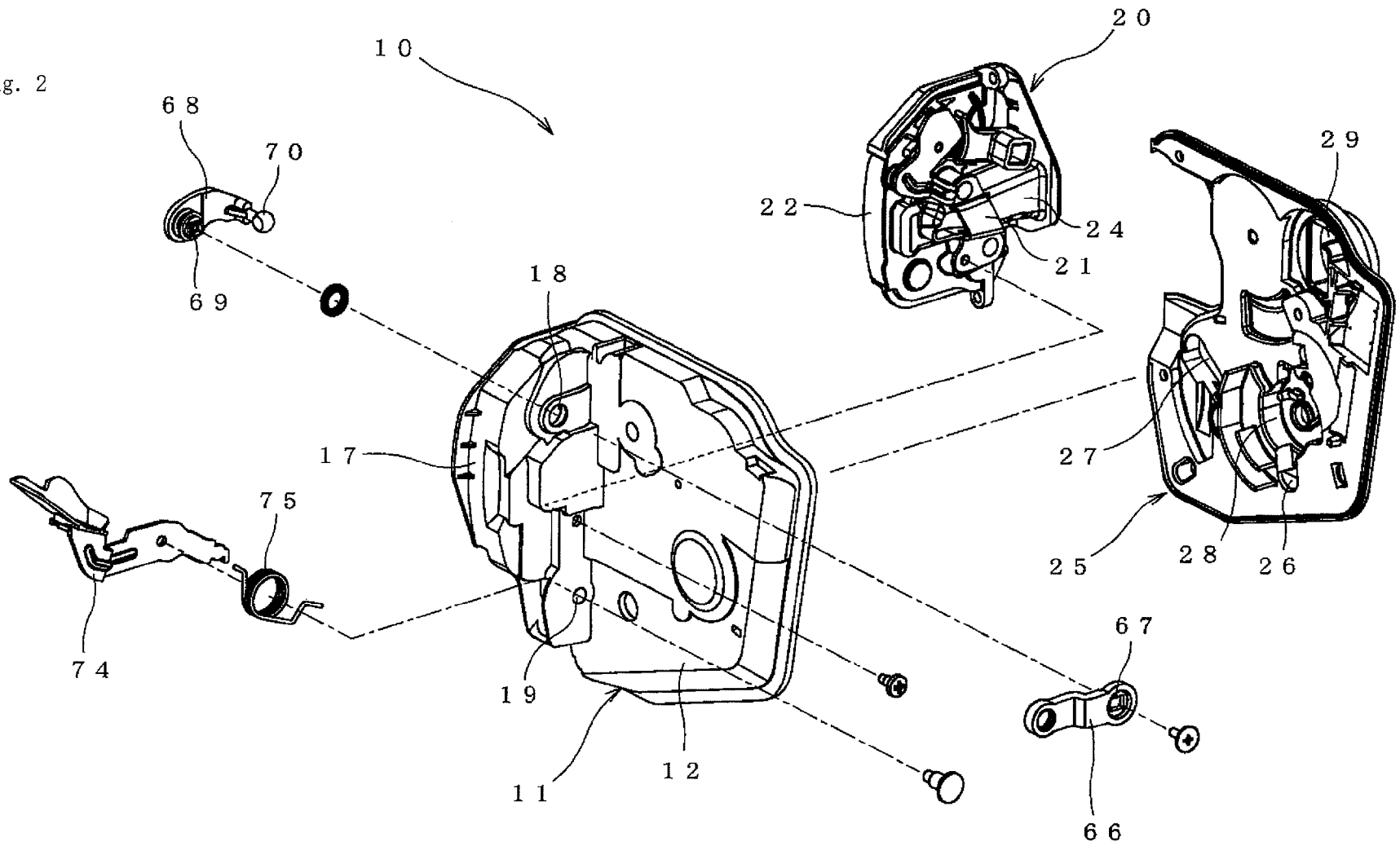
FIG. 2 is an exploded perspective view showing an outline structure of the door lock device.

FIGS. 1 and 2 show a door lock device in accordance with the embodiment of the present invention. The door lock device is installed to a door in a vehicle, and is structured such as to detachably engage a striker arranged in a vehicle body. In the door lock device, a latch mechanism engaging the striker and a lock mechanism for locking and unlocking an engaged state of the striker by the latch mechanism are arranged in a casing 10.

The casing 10 is provided with a main case 11 in which each of parts constructing the lock mechanism is arranged, a sub case 20 in which each of parts constructing the latch mechanism is arranged, and a cover 25 which covers a lock mechanism arranged surface in the main case 11.

Figure 3:
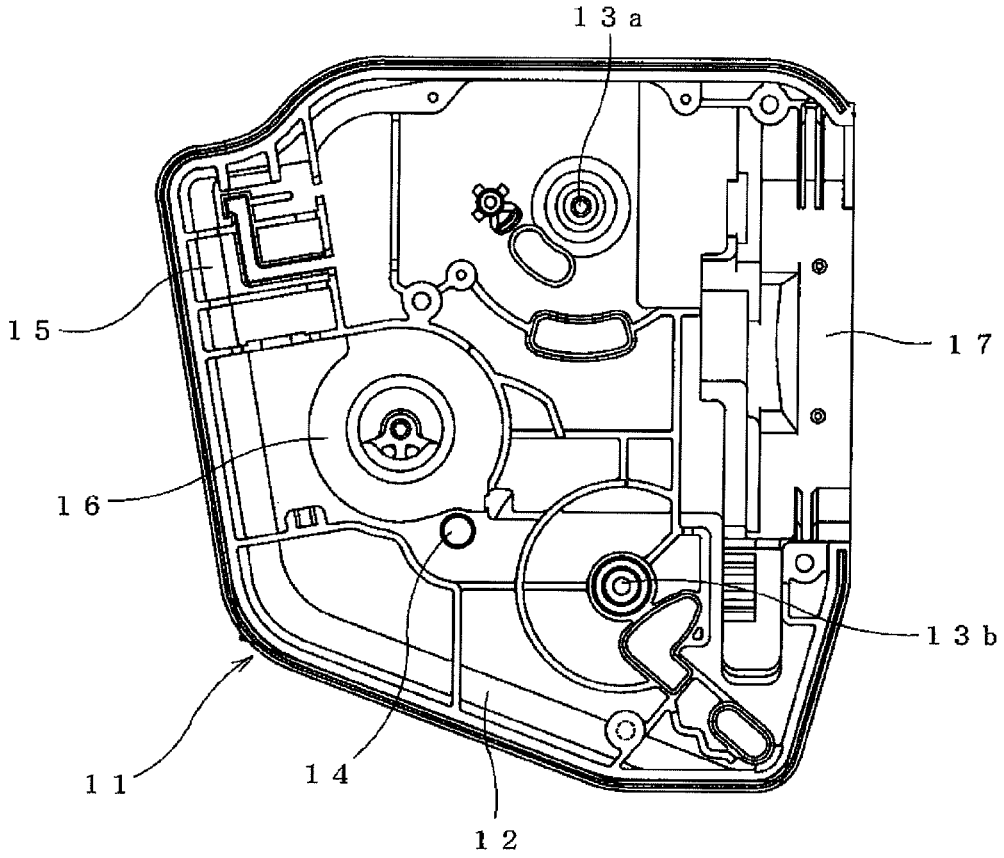
FIG. 3 is a front elevational view showing a lock mechanism arranging portion of a main case.

The main case 11 in accordance with the present embodiment has an L-shape in plan view in which a lock mechanism arranging portion 12 and a latch mechanism cover portion 17 are arranged, as shown in FIG. 2. The lock mechanism arranging portion 12 is provided with attaching shaft portions 13*a* and 13*b* rotatably and pivotally attaching a lock plate 43 and an inner lever 59 described below, as shown in FIGS. 1A and 3. Further, a shaft hole 14 for rotatably arranging a knob lever 51 is provided in a left side portion of the attaching shaft portion 13*b* of the inner lever 59, in the figure. A drive motor arranging portion 15 and a cam member arranging portion 16 are provided in a further upper left side of the shaft hole 14. The latch mechanism cover portion 17 covers an opening portion of the sub case 20 in which the latch mechanism is arranged. As shown in FIG. 2, the latch mechanism cover portion 17 is provided with a first attaching hole portion 18 for rotatably installing a first key lever 66 and a key shaft 68. Further, there is provided a second attaching hole portion 19 for rotatably installing a push lever 74 by means of rivet.

The sub case 20 is installed to the latch mechanism cover portion 17 of the main case 11. The sub case 20 is provided with a metal reinforcing plate 21 in a surface opposing the latch mechanism cover portion 17, and is provided with a surface plate 22 in a surface in an opposite side, as shown in FIGS. 1B and 2. The surface plate 22 is provided with an insertion groove (not shown) for inserting the striker, and is provided with an attaching hole portion (not shown) rotatably installing a fork 30 and a claw 33 constructing the latch mechanism. Further, the sub case 20 is provided with an insertion hole 23 through which an operation receiving portion 36 of the claw 33 is inserted so as to protrude into the lock mechanism arranging portion 12. Further, an insertion recess 24 depressed toward the latch mechanism cover portion 17 is provided at a corresponding position to the insertion groove of the surface plate 22.

The cover 25, as shown in FIG. 2, is installed to the lock mechanism arranging portion 12 of the main case 11. The cover 25 is provided with a first insertion portion 26 through which a lock knob connecting portion 53 of a knob lever 51 is passed and protruded to an outer side, and a second insertion portion 27 through which an inner handle coupling portion 62 of an inner lever 59 is passed and protruded to an outer side. Further, there are provided with a recess 28 for securing a rotating region of the knob lever 51, and a connector connecting port 29 for passing through a connector (not shown) for electrically connecting a signal line in a locked state or the like, an electric power line, and the like.

Further, the latch mechanism in accordance with the present embodiment assembled in the sub case 20 is provided with the fork 30 engaging the striker, and the claw 33 engaged with the fork 30 so as to maintain the fork 30 in a state of holding the striker, as shown in FIG. 1B.

The fork 30 has an approximately U-shape and is rotatably attached to the surface plate 22. The fork 30 is provided with an engaging groove 31 to which the striker can be inserted, and is energized to an open position corresponding to an illustrated state by a spring (not shown). Further, the fork 30 is provided with an engaging portion 32 in an end portion positioned in a clockwise side of an open leading end of the engaging groove 31.

The claw 33 is rotatably and pivotally attached to the surface plate 22 in the same manner as the fork 30. The claw 33 is provided with an engagement receiving portion 34 engaging the engaging portion 32 of the fork 30, and is energized to a lock position corresponding to an illustrated state by a spring 35. Further, the claw 33 is provided with an operation receiving portion 36 at an opposite side to the engagement receiving portion 34. The operation receiving portion 36 passes through the insertion hole 23 of the sub case 20 and is positioned within the lock mechanism arranging portion 12 in order to release the engaged state of the striker.

If the striker advances into the engaging groove 31 of the fork 30 by closing the door, the latch mechanism rotates in a counterclockwise direction in the figure with a pressing of the striker caused by a closing force of the door. Further, the engaging groove 31 is positioned in such a manner as to extend in an approximately orthogonal direction with respect to the insertion recess 24. In this state, the engaging portion 32 is engaged to the engagement receiving portion 34 of the claw 33 so that the engaged state of the striker is maintained. If the operation receiving portion 36 of the claw 33 is actuated upward in this state, the claw 33 is rotated in a clockwise direction, whereby the engagement between the engagement receiving portion 34 and the engaging portion 32 of the fork 30 is released. As a result, the fork 30 is rotated to an illustrated open position, and the engagement of the striker is released. Further, if an upward actuating force of the operation receiving portion 36 is released, the claw 33 is returned to the engaged position by an energizing force of the spring 35.

Further, the lock mechanism in accordance with the present embodiment assembled in the main case 11 is provided with a link 37 for actuating the claw 33 in an engagement releasing direction, and a lock plate 43 for enabling or disenabling the actuation of the claw 33 by the link 37, as shown in FIG. 1A. Further, a knob lever 51 locking and unlocking the link 37 via the lock plate 43 is arranged as an inner lock operating system. An inner lever 59 opening the latch mechanism via the link 37 is arranged as an inner handle operating system. Further, first and second key levers 66 and 71 and a key shaft 68 which lock and unlock the link 37 via the lock plate 43 are arranged as an outer lock operating system. A push lever 74 opening the latch mechanism via the link 37 is arranged as an outer handle operating system. Further, a drive motor 76 and a cam member 78 are arranged as an electrically driven lock operating system.

Figure 4:
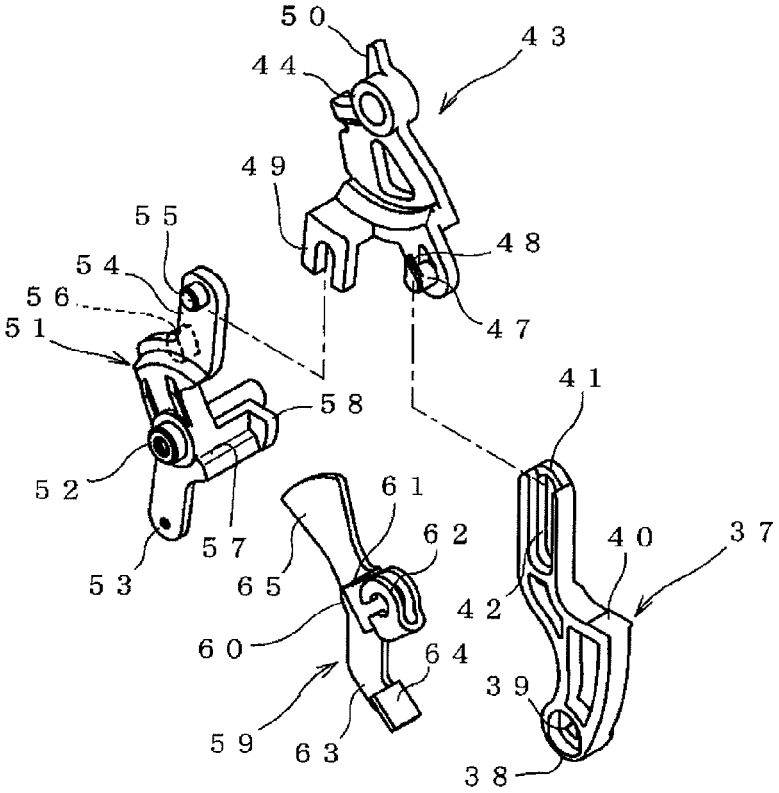
FIG. 4 is an exploded perspective view of a link, a lock plate, a knob lever and an inner lever.

The link 37 is structured so as to move in an upward direction by an application of a rotating force of the inner lever 59 or the push lever 74, as shown in FIGS. 1A and 4 to come into contact with the operation receiving portion 36 of the claw 33, allowing the claw 33 to rotate to release the engagement of the fork 30. Further, the link 37 is structured such that one end is coupled to the lock plate 43, the other end is coupled to the push lever 74, and the link 37 moves (oscillates) between an unlock position capable of engaging with the operation receiving portion 36 of the claw 33 and a lock position incapable of engaging therewith, by the rotation of the lock plate 43. In particular, the link 37 is provided with a passive portion 38 receiving the rotation of the inner lever 59 at a lower end. A coupling hole 39 is provided in the passive portion 38 so that the push lever 74 is movably coupled to the coupling hole 39, whereby the rotation of the push lever 74 is received. An operating portion 40 coming into contact with the operation receiving portion 36 of the claw 33 is provided in an upper portion of the passive portion 38. Further, a lock plate coupling portion 41 is continuously provided next to the operating portion 40 in such a manner as to extend in an approximately J-shaped form. The lock plate coupling portion 41 is provided with a slide groove 42 capable of moving relatively to the lock plate 43 at a time of sliding upward by the application of the rotating force of the inner lever 59 or the push lever 74.

The lock plate 43 is structured such as to position the link 37 at the unlock position and the lock position. The lock plate 43 is provided with an attaching portion 44 rotatably attached to the attaching shaft portion 13*a* of the main case 11, and has an approximately fan shape with a top portion in the attaching portion 44. The lock plate 43 is provided with a spring receiving portion 46 which receives an action spring 45 for positioning and holding a state of being moved to the lock position and the unlock position. Further, an outer peripheral edge forming a circular arc shape of the lock plate 43 is provided with a slide shaft 47 engaging the slide groove 42 at a side in which the link 37 is arranged. The slide shaft 47 is provided with an engagement pawl portion 48 protruding approximately in a triangular shape in a leading end portion. Further, an outer peripheral edge of the lock plate 43 is provided with a knob lever engaging and attaching portion 49 formed in an approximately U-shaped form at a side in which the knob lever 51 is arranged, corresponding to an inverse side to the slide shaft 47. Further, the attaching portion 44 is provided in a protruding manner with an unlock operation receiving portion 50 receiving an unlock operation of the second key lever 71. Note that an edge of the lock plate 43 at the side in which the slide shaft 47 is provided constructs a lock operation receiving portion receiving the lock operation of the key lever 71.

The knob lever 51 is coupled to a lock knob (not shown) provided in a vehicle inner side of the door by a wire or the like, is engaged with the lock plate 43, and is structured such as to move the link 37 to the lock position or the unlock position by actuating the lock plate 43. The knob lever 51 is provided with a rotating shaft portion 52 for pivotally attaching to the shaft hole 14 of the main case 11. Further, the knob lever 51 is provided with a lock knob connecting portion 53 protruded to an outer side of the casing 10 from the first insertion portion 26 of the cover 25 in such a manner as to protrude in a diametrical direction from the rotating shaft portion 52. Further, the knob lever 51 is provided with an arm portion 54 extending approximately in an L-shaped form toward a knob lever engaging and attaching portion 49 of the lock plate 43 so as to protrude from the rotating shaft portion 52. A leading end of the arm portion 54 is provided with an engagement protruding portion 55 inserted and engaged into a groove of the knob lever engaging and attaching portion 49. Further, the arm portion 54 is provided in a protruding manner with a cam receiving portion 56 engaged with a cam groove 80 of a cam member 78 positioned at a back portion. Further, in the present embodiment, the knob lever 51 is provided with an engagement receiving portion 57 receiving a rotating motion of the inner lever 59. The engagement receiving portion 57 is provided in such a manner as to bulge out from a root portion (a base portion) in which the lock knob connecting portion 53 protrudes from the rotating shaft portion 52 toward a side of the inner lever 59, and along an axial direction from an outer periphery of the rotating shaft portion 52. In this engagement receiving portion 57, a slidable contact surface portion 58 for stabilizing the rotating motion is provided in an end portion positioned in a side of a closed surface of the main case 11.

The inner lever 59 is coupled to an inner handle (not shown) provided in the vehicle inner side of the door, is engaged (brought into contact) with the passive portion 38 of the link 37, and is structured such as to slide the link 37 toward a side of the operation receiving portion 36 of the claw 33. Further, in a state that the link 37 is set to the unlock position, the structure is made such as to rotate the claw 33 by pressing the operation receiving portion 36 via the link 37 so as to release the engaged state of the striker by the fork 30. The inner lever 59 is provided with an attaching portion 60 rotatably attached to the attaching shaft portion 13*b* of the main case 11. The inner lever 59 is provided with an approximately L-shaped arm portion 61 in such a manner as to protrude to an outer side of the casing 10 from the second insertion portion 27 of the cover 25. An inner handle coupling portion 62 is provided in a leading end of the arm portion 61. Further, the inner lever 59 is provided with an approximately J-shaped link operating portion 63 in such a manner that the passive portion 38 of the link 37 is positioned on a rotating locus about the attaching portion 60 in an assembled state. A leading end of the link operating portion 63 is provided with a contact surface portion 64 which is bent for securing a sufficient contact area with respect to the passive portion 38. Further, in the present embodiment, the inner lever 59 is provided with an engaging portion 65 engaged with the engagement receiving portion 57 of the knob lever 51 so as to move the link 37 to the unlock position via the knob lever 51 and the lock plate 43, in a state that the link 37 is positioned at the lock position. The engaging portion 65 is formed in such a dimension (radius) as to be incapable of engaging with the engagement receiving portion 57 of the knob lever 51 oscillating in an interlocking manner, in a state that the link 37 is positioned at the unlock position.

The link 37, the knob lever 51 and the inner lever 59 are structured such as to be arranged adjacently in a lateral direction, so that the inner lever 59 is positioned between the link 37 and the knob lever 51. Accordingly, it is possible to relatively easily achieve the structure which can engage the inner lever 59 with the link 37, in a state that the engagement receiving portion 57 of the knob lever 51 and the engaging portion 65 of the inner lever 59 can be securely engaged with each other.

The first key lever 66 is coupled to a cylinder lock arranged in such a manner as to be exposed to the vehicle outer side of the door, and is rotatably attached to the first attaching hole portion 18 of the latch mechanism cover portion 17 of the main case 11 together with the key shaft 68, as shown in FIG. 2. The first key lever 66 is provided with a coupling hole 67 formed in a square shape, for disenabling a relative rotation with respect to the key shaft 68.

The key shaft 68 is arranged opposite to the first key lever 66 with respect to a wall of the latch mechanism arranging portion and has an L-shaped form provided with a first coupling portion 69 coupled to the coupling hole 67 on one end. The other end of the key shaft 68 is provided with a second coupling portion 70 coupled to the second key lever 71. The second coupling portion 70 is structured such as to transmit the rotating force of the first key lever 66 to the second key lever 71 positioned in an orthogonal direction in its rotating direction.

The second key lever 71 is pivotally attached to the attaching shaft portion 13*a* which pivotally attaches the lock plate 43, as shown in FIG. 1A, and is provided with a coupled portion 72 coupling the second coupling portion 70 of the key shaft 68. The coupled portion 72 constructs a lock operating portion for locking the lock plate 43 by coming into contact with a side edge of the lock plate 43. Further, the second key lever 71 is provided with a contact point portion 73 for detecting a rotational position of the second key lever 71, and a lower portion thereof constructs an unlock operating portion for unlocking the lock plate 43 by coming into contact with the unlock operation receiving portion 50 of the lock plate 43.

The push lever 74 is coupled to an outer handle (not shown) provided in the vehicle outer side of the door, is coupled to (engaged with) the coupling hole 39 of the link 37, and is rotatably attached to the second attaching hole portion 19 of the latch mechanism cover portion 17, as shown in FIG. 2. The push lever 74 is energized by an energizing spring 75 in a direction in which the link 37 breaks away from the operation receiving portion 36 of the claw 33.

The drive motor 76 can rotate the cam member 78 forward and backward, and a worm 77 is attached to an output shaft thereof, as shown in FIG. 1A.

The cam member 78 is rotatably arranged in such a manner as to be positioned in a lower portion of the cam receiving portion 56 of the knob lever 51, and an outer peripheral portion thereof is provided with a worm wheel 79 engaged with the worm 77. In this cam member 78, a cam groove 80 is provided in a recessed manner in a top surface side opposing to the side of the knob lever 51, in such a manner that a distance from a center gradually expands from the center side toward the outer peripheral portion. Further, the cam member 78 is positioned (energized) at a neutral position by an energizing spring (not shown). The cam member 78 is rotated in such a manner that the cam receiving portion 56 is moved to the center side, thereby locking the link 37 via the knob lever 51 and the lock plate 43. Further, the cam member 78 is rotated in such a manner that the cam receiving portion 56 moves to the outer peripheral side, thereby unlocking the link 37 via the knob lever 51 and the lock plate 43.

Next, an operation of the lock mechanism in the door lock device will be described.

Figure 5:
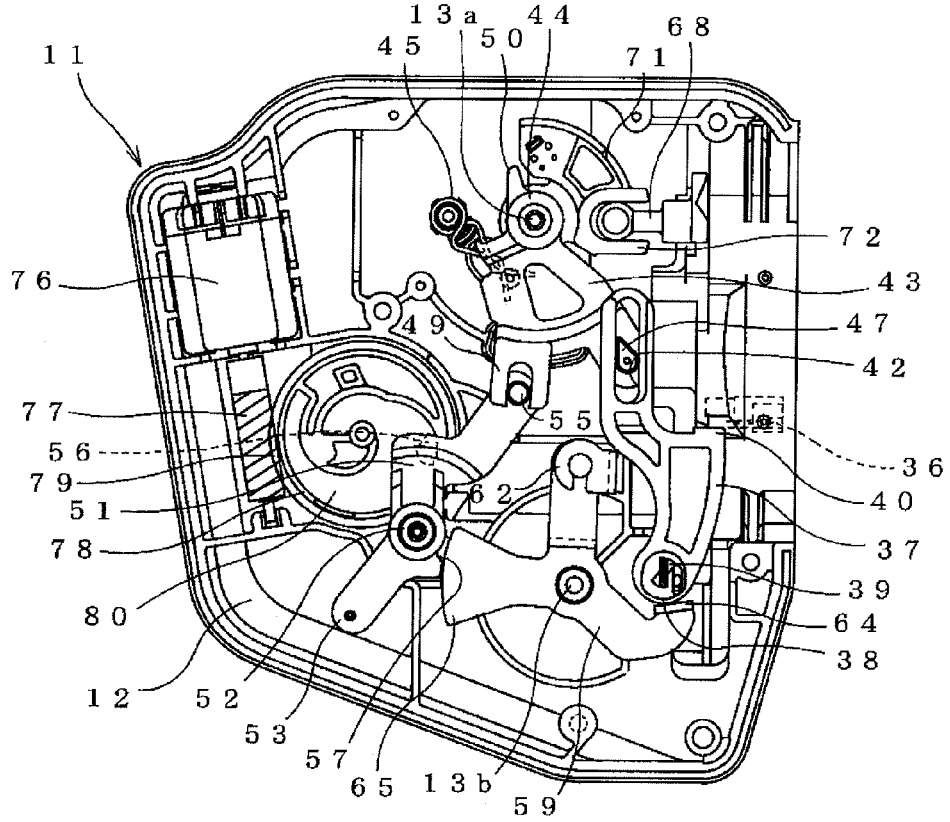
FIG. 5 is a front elevational view showing an operating state of the door lock device.

First of all, in the unlocked state shown in FIG. 1A, when the inner handle is operated, the inner lever 59 rotates in the counterclockwise direction to come into contact with the passive portion 38 of the link 37, as shown in FIG. 5. Accordingly, the link 37 moves in a vertical direction along the slide groove 42 extending in the vertical direction, whereby the operating portion 40 of the link 37 is engaged with the operation receiving portion 36 of the claw 33. As a result, the engaged state of the striker by the fork 30 is released by pressing the operation receiving portion 36 with the movement of the link 37 so as to rotate the claw 33. Further, when the outer handle is operated, the push lever 74 is rotated, whereby the link 37 is moved upward, and the engagement of the striker by the fork 30 is released in the same manner.

Figure 6:
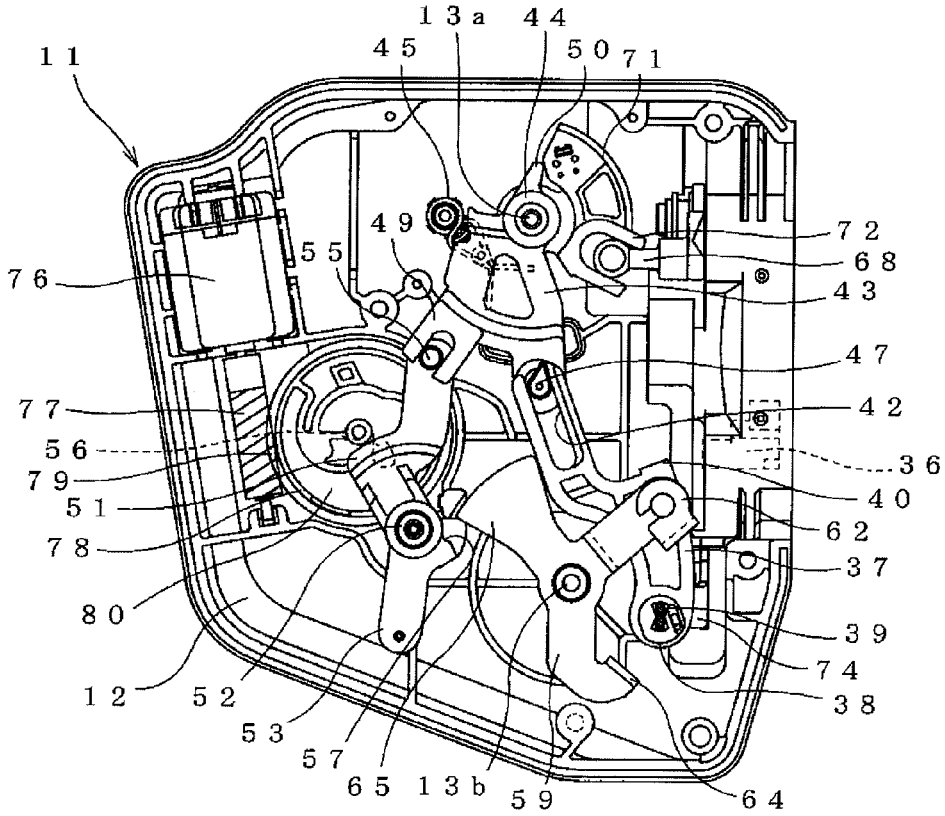
FIG. 6 is a front elevational view showing other operating state of the door lock device.

If the lock knob in the vehicle inner side is operated in this unlocked state, the knob lever 51 rotates in the counterclockwise direction as shown in FIG. 6. Accordingly, the lock plate 43 rotates in the clockwise direction, and the link 37 rotates in the counterclockwise direction in conjunction with the lock plate 43 to establish a lock state. Further, if the cylinder lock in the vehicle outer side is operated, the lock plate 43 rotates in the clockwise direction in the same manner via the first key lever 66, the key shaft 68 and the second key lever 71, and the link 37 rotates to the lock position in conjunction with the lock plate 43. Further, if the lock operation is carried out by a remote control or the like, the cam member 78 is rotated by the drive motor 76, whereby the knob lever 51 and the lock plate 43 rotate in the same manner, and the link 37 rotates to the lock position in conjunction with the lock plate 43.

In this locked state, the clockwise rotation of the lock plate 43 establishes a state in which the link 37 moves toward an upward left direction. Accordingly, if the outer handle is operated, and the passive portion 38 of the link 37 is pressed upward, the link 37 moves obliquely upward along the slide groove 42 extending in an inclined manner away from the operation receiving portion 36, whereby the operating portion 40 of the link 37 can not be engaged with the operation receiving portion 36 of the claw 33. As a result, since it is impossible to rotate the claw 33 by pressing the operation receiving portion 36 in the movement of the link 37 under this state, the engaged state of the striker by the fork 30 cannot be released.

Figure 7:
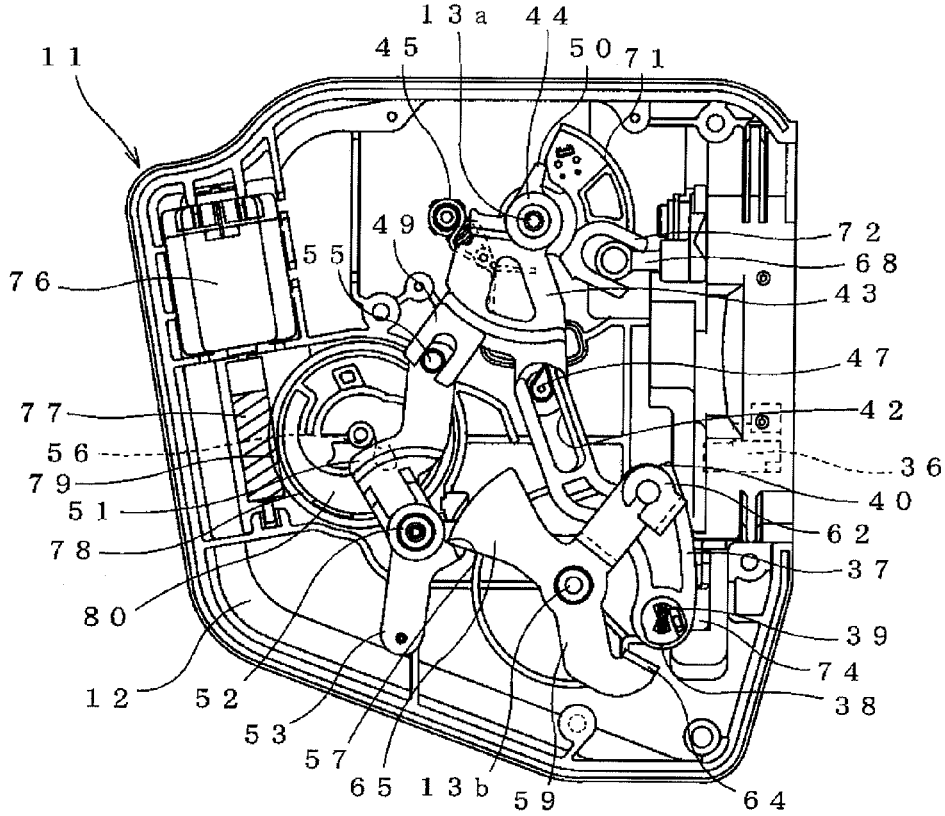
FIG. 7 is a front elevational view showing other operating state of the door lock device.
Figure 8:
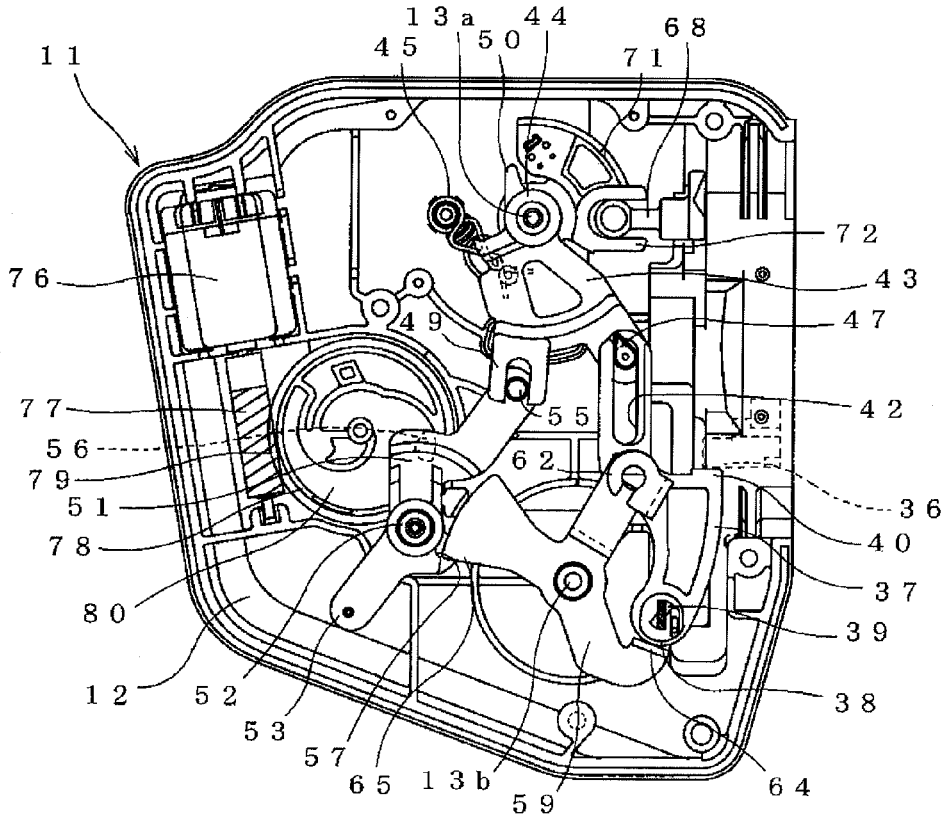
FIG. 8 is a front elevational view showing other operating state of the door lock device.

On the other hand, in the lock actuator in accordance with the present embodiment, if the inner handle is operated under the locked state, the inner lever 59 rotates in the counterclockwise direction, as shown in FIG. 7, whereby the engaging portion 65 of the inner lever 59 comes into contact (engages) with the engagement receiving portion 57 of the knob lever 51. If the inner lever 59 is further rotated under this state, the knob lever 51 receives the rotating force to rotate in the clockwise direction. As a result, the lock plate 43 and the link 37 rotate to the unlock position. Further, the rotation of the knob lever 51 allows the engagement receiving portion 57 of the knob lever 51 and the engaging portion 65 of the inner lever 59 to keep a non-engaged positional relation.

Subsequently, in the inner lever 59, the contact surface portion 64 comes into contact with the passive portion 38 of the link 37. Thereafter, in the same manner as the operation in the unlocked state, the link 37 moves in the vertical direction along the slide groove 42 extending in the vertical direction, whereby the operating portion 40 of the link 37 engages with the operation receiving portion 36 of the claw 33, and the claw 33 is rotated. Accordingly, the engagement of the striker by the fork 30 is released.

As mentioned above, in the door lock device of the present invention, if the inner handle is operated in the locked state, the engaging portion 65 of the interlocking inner lever 59 engages with the engagement receiving portion 57 of the knob lever 51, the knob lever 51 moves, whereby the link 37 moves to the unlock position via the lock plate 43. As a result, in the same manner as the operation in the unlocked state, it is possible to actuate the latch via the link 37 by the inner lever 59 so as to release the engagement of the striker.

Figure 9:
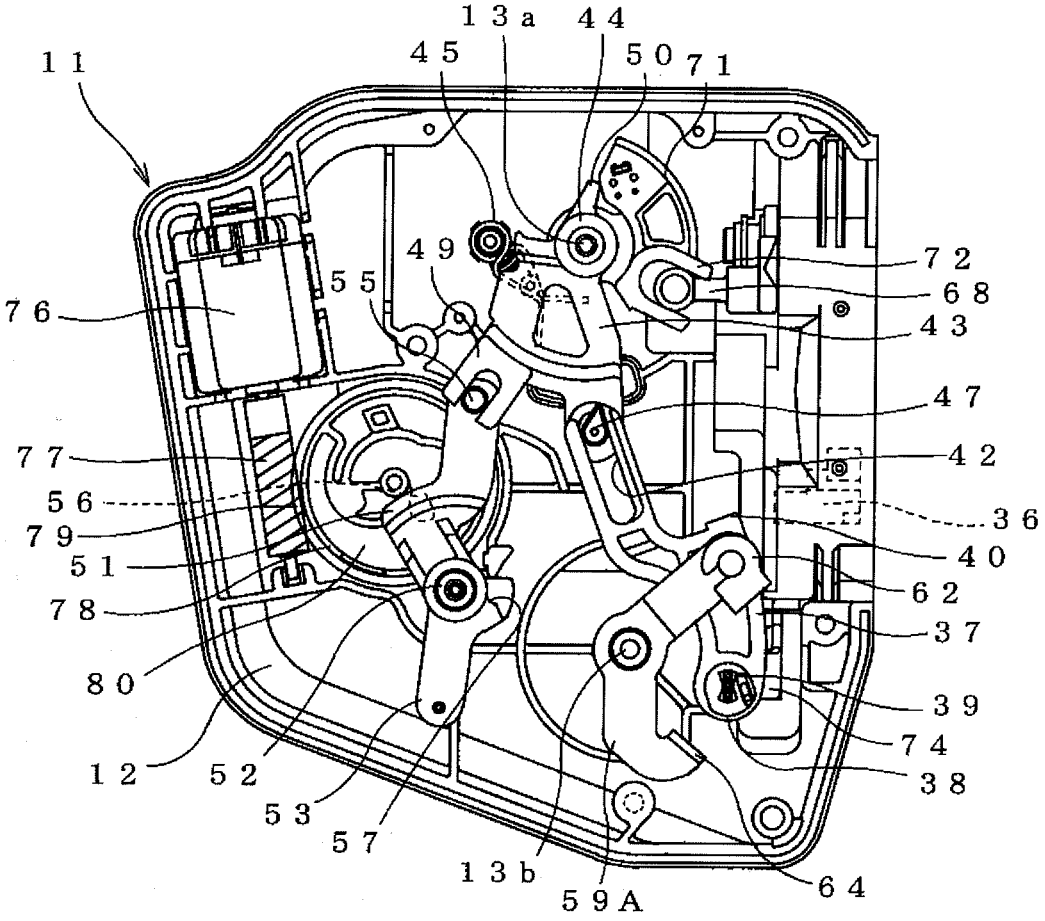
FIG. 9 is a front elevational view showing an application example of the door lock device.

On the other hand, in a case of further setting a second inner lever 59A having no engaging portion 65 in addition to the inner lever 59, and assembling the inner lever 59A, as shown in FIG. 9, it is impossible to engage with the engagement receiving portion 57 of the knob lever 51 even by operating the inner handle in the locked state. Accordingly, the door lock device mounting the inner lever 59A thereon can not open the door by operating the inner handle in the locked state.

In other words, in the present invention, it is possible to provide an override function capable of opening the door in a locked state, by setting the engagement receiving portion 57 in the knob lever 51, and setting the engaging portion 65 in the inner lever 59. On the other hand, it is possible to construct the door lock device with the override function and the door lock device without the override function, by changing only one part 59 or 59A, and using the other parts in common. As a result, since it is possible to widely use common parts, it is possible to reduce the cost of the door lock device itself mounted to the vehicle, and to reduce a cost of a whole vehicle.

It is possible to set presence or absence of the override function by setting a second knob lever (not shown) having no engagement receiving portion 57 in place of the second inner lever 59A, and selectively assembling the knob lever 51. Of course, it is possible to selectively assemble both the knob lever 51 and the inner lever 59.

In this connection, since the door lock device of the Japanese Unexamined Patent Publication No. 2001-248348 described in the related art is structured such that the second sublever and the open lever are always actuated by operating the inside lever, it is impossible to set lock or unlock by operating the lock knob. Accordingly, it is impossible to construct the door lock device without the override function, by doing away with the engaging portion as in the present invention.

Further, in the present invention, the push lever 74 interlocking with the operation of the outer handle provided in the vehicle outer side of the door is engaged with the link 37, and the link 37 is used in common between the inner handle operating system and the outer handle operating system. Accordingly, since the link 37 is directly operated by the inner lever 59 and the push lever 74, it is possible to construct with a reduced number of parts (reducing a number of parts), and to reduce a manufacturing cost.

Further, since the latch mechanism is provided with the fork 30 engaging the striker, and the claw 33 engaged with the fork 30, and the claw 33 is provided with the operation receiving portion 36 with which the link 37 comes into contact, it is possible to further reduce the parts number, and reduce the manufacturing cost.

It should be noted that the door lock device of the present invention is not limited to the structure of the embodiment, but can be variously modified.

What is claimed is:

1. A door lock device comprising:

a latch mechanism detachably engaging a striker and having an operation receiving portion for releasing an engaged state;

a link being movable between an unlock position capable of engaging with the operation receiving portion of the latch mechanism and capable of releasing the engaged state of the striker, and a lock position incapable of engaging with the operation receiving portion and incapable of releasing the engaged state of the striker;

a lock plate positioning the link at the unlock position and the lock position, the lock plate having a first end engaging with the link;

a knob lever coupled to a lock knob provided in a vehicle inner side of a door and engaged with a second end of the lock plate, the second end being opposite relative to the first end of the lock plate, the knob lever actuating the lock plate to move the link to the lock position or the unlock position; and an inner lever coupled to an inner handle provided in the vehicle inner side of the door and engaged with the link, the inner lever releasing the engaged state of the striker by the latch mechanism via the link in a state that the link is moved at the unlock position, wherein the knob lever is provided with an engagement receiving portion which is configured to engage with the inner lever in a rotation direction in a state where the link is moved to the lock position, and the inner lever is provided with an engaging portion, wherein the engaging portion is configured to be capable of engaging with the engagement receiving portion of the knob lever in a rotation direction to move the knob lever so that the link is moved to the unlock position via the lock plate, in a state where the link is moved to the lock position, and is configured to be incapable of engaging with the engagement receiving portion of the knob lever, in a state where the link is moved to the unlock position, wherein the knob lever is provided with a cam receiving portion engaged with a cam groove of a cam member rotated by a drive motor so that rotation of the cam member by the drive motor allows the knob lever to rotate, and wherein a case is provided so that the inner lever, the knob lever and the lock plate are operably supported on a first shaft, a second shaft and a third shaft, respectively, which are parallel to each other and formed on surfaces of the case that lie in a first plane formed perpendicular to a second plane on which the latch mechanism is disposed, and wherein the inner lever, the link and the knob lever are arranged adjacent to one another in a lateral direction of the case, in such a manner that the inner lever is positioned between the link and the knob lever and that the engaging portion of the inner lever protrudes from the first shaft toward the engagement receiving portion of the knob lever and is capable of engaging with the engagement receiving portion of the knob lever in a rotation direction of the inner lever.

2. The door lock device according to claim 1, further comprising a push lever that is coupled to an outer handle provided in an outer vehicle side of the door, and is engaged with the link.

3. The door lock device according to claim 1, wherein the latch mechanism includes a fork engaging the striker, and a claw engaged with the fork to maintain the fork in a state of holding the striker, and the operation receiving portion is provided in the claw.

4. The door lock device according to claim 1, further comprising a push lever that is coupled to an outer handle provided in an outer vehicle side of the door, and is engaged with the link.

5. The door lock device according to claim 1, wherein the latch mechanism includes a fork engaging the striker, and a claw engaged with the fork to maintain the fork in a state of holding the striker, and the operation receiving portion is provided in the claw.

6. The door lock device according to claim 2, wherein the latch mechanism includes a fork engaging the striker, and a claw engaged with the fork to maintain the fork in a state of holding the striker, and the operation receiving portion is provided in the claw.

7. A door lock device comprising:

a latch mechanism detachably engaging a striker and having an operation receiving portion for releasing an engaged state;

a link being movable between an unlock position capable of engaging with the operation receiving portion of the latch mechanism and capable of releasing the engaged state of the striker, and a lock position incapable of engaging with the operation receiving portion and incapable of releasing the engaged state of the striker;

a lock plate positioning the link at the unlock position and the lock position, the lock plate having a first end engaging with the link;

a knob lever coupled to a lock knob provided in a vehicle inner side of a door and engaged with a second end of the lock plate opposite to the first end of the lock plate, the knob lever actuating the lock plate to move the link to the lock position or the unlock position; and an inner lever coupled to an inner handle provided in the vehicle inner side of the door and engaged with the link, the inner lever releasing the engaged state of the striker by the latch mechanism via the link in a state that the link is moved at the unlock position, wherein the knob lever is provided with a cam receiving portion directly engaged with a cam groove of a cam member rotated by a drive motor so that rotation of the cam member by the drive motor allows the knob lever to rotate, wherein the knob lever is selected from a first knob lever and a second knob lever, the first knob lever being provided with an engagement receiving portion which is configured to engage with the inner lever in a rotation direction in a state where the link is moved to the lock position, and the second knob lever being not provided with the engagement receiving portion, wherein the inner lever is selected from a first inner lever and a second inner lever, the first inner lever being provided with an engaging portion, wherein the engaging portion is configured to be capable of engaging with the engagement receiving portion of the knob lever in a rotation direction to move the knob lever so that the link is moved to the unlock position via the lock plate, in a state where the link is moved to the lock position, and is configured to be incapable of engaging with the engagement receiving portion of the knob lever, in a state where the link is moved to the unlock position, and the second inner lever being not provided with the engagement receiving portion, and wherein the door lock device having an override function can be provided by selecting the first knob lever and the first inner lever, and the door lock device having no override function can be provided by changing the first knob lever to the second knob lever and/or by changing the first inner lever to the second inner lever.

* * * * *